US007404747B2

(12) United States Patent
Shinde et al.

(10) Patent No.: US 7,404,747 B2
(45) Date of Patent: Jul. 29, 2008

(54) TILLER HANDLE FOR OUTBOARD MOTORS

(75) Inventors: Yasuo Shinde, Saitama (JP); Shoichi Rinzaki, Saitama (JP); Toru Kimura, Saitama (JP); Michiharu Ohkawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/790,324

(22) Filed: Apr. 25, 2007

(65) Prior Publication Data

US 2008/0038967 A1 Feb. 14, 2008

(30) Foreign Application Priority Data

Apr. 28, 2006 (JP) ..... 2006-125026

(51) Int. Cl.
*B63H 5/125* (2006.01)

(52) U.S. Cl. ..... 440/63

(58) Field of Classification Search ..... 440/53, 440/63; 114/144 R; 74/480 B
See application file for complete search history.

(56) References Cited

U.S. PATENT DOCUMENTS 5,632,657 A * 5/1997 Henderson ..... 440/6
6,352,456 B1 * 3/2002 Jaszewski et al. ..... 440/53

FOREIGN PATENT DOCUMENTS

JP 62-192997 U 12/1987

* cited by examiner

*Primary Examiner*—Ed Swinehart
(74) *Attorney, Agent, or Firm*—Westerman, Hattori, Daniels & Adrian, LLP.

(57) ABSTRACT

Proposed is a height adjusting mechanism for a tiller handle (23) of an outboard motor (1). An adjustment piece (45) is detachably attached to the front end of a handle support bracket (22) which extends rearwards from the outboard motor main body (3). The adjustment piece is configured to be attached to the front end of the handle support member in two or more different positions and provided with a corresponding number of spacer portions (47-50) having different thicknesses so as to interpose a selected one of the spacer portions between corresponding stopper surfaces (41, 42) of the tiller handle and handle support bracket depending on the positions of the adjustment piece. Thereby, the height adjusting mechanism for the tiller handle is avoided from protruding laterally or vertically from the base end of the tiller handle so that the external appearance is not impaired and interferences with the surrounding parts can be effectively prevented. Also, the height of the tiller handle can be selected from two or more possible positions.

6 Claims, 4 Drawing Sheets

TILLER HANDLE FOR OUTBOARD MOTORS

TECHNICAL FIELD

The present invention relates to an outboard motor for relatively small watercraft, and in particular to an arrangement for adjusting the height of a tiller handle when the tiller handle is at its normal operating position.

BACKGROUND OF THE INVENTION

A watercraft fitted with an outboard motor is typically steered by pivoting the outboard motor mounted on a transom provided in a rear end of the watercraft about a vertical pivot axis. In case of small and medium-sized watercraft, it can be effected remotely by using a steering wheel provided in the cabin, but it is more common to use a steering handle bar (typically called as tiller handle) extending forwardly directly from the outboard motor. A tiller handle is placed at a substantially horizontal position (operating position) during normal operation of the watercraft, and can be held in a more vertically raised position (retracted position) when the outboard motor is tilted up because the watercraft is in shallow waters or moored.

It is known to make the height of a tiller handle adjustable during normal operation so as to accommodate different postures and builds of the users. The height of a tiller handle can be made adjustable by passing a pin through a part of the tiller handle and a selected one of a plurality of holes provided at different heights of a support bracket or by turning a vertical adjust screw abutting an upper surface of an end of the tiller handle on the other side of the pivot pin as seen from the user as disclosed in Japanese UM publication S62-192997.

The previously proposed height adjusting mechanisms for tiller handles have some problems in appearance and space requirements. The arrangement using a pin for adjustment is not favorable in appearance because the head and tip of the pin protrude sideways from the support bracket. Also, some lateral space is required for placing the pin into and out of the support bracket. The arrangement using an adjust screw is also unfavorable in appearance because the head of the adjust screw and a lock nut for the adjust screw protrude in the vertical direction. Also, some vertical space is required for turning the adjust screw and fastening the lock nut by using a socket wrench, and a measure must be taken so as to avoid interference with the engine cover.

As the height of a tiller handle is not required to be adjusted very often, the adjusting mechanism is desired to be concealed during normal operation of the tiller handle for a favorable appearance and to be compact enough not to cause any interference with other parts of the outboard motor. It is also desirable that the adjusting mechanism is readily accessible when an adjustment is required.

BRIEF SUMMARY OF THE INVENTION

In view of such problems of the prior art, a primary object of the present invention is to provide a tiller handle for outboard motors fitted with a height adjusting mechanism which is both favorable in appearance and compact in size.

A second object of the present invention is to provide a tiller handle for outboard motors whose height can be adjusted both easily and reliably.

According to the present invention, such objects can be at least partly accomplished by providing an outboard motor for watercraft, comprising: a handle support bracket extending forward from a main body of an outboard motor, a front end of the handle support bracket being provided with a first stopper surface on an upper side thereof; a tiller handle having a base end pivotally supported by the front end of the handle support bracket around a lateral pivot axis between an upwardly tilted retracted position and a forwardly extending operating position, the base end of the tiller handle being provided with a second stopper surface that cooperates with the first stopper surface to determine a height of the tiller handle on a lower side thereof; and an adjustment piece detachably attached to the front end of the handle support bracket; wherein the adjustment piece is configured to be attached to the front end of the handle support member in two or more different positions and provided with a corresponding number of spacer portions having different thicknesses so as to interpose a selected one of the spacer portions between the first and second stopper surfaces depending on the positions of the adjustment piece.

Thereby, the mechanism for adjusting the height of the tiller handle is avoided from protruding laterally or vertically from the base end of the tiller handle so that the external appearance is not impaired and interferences with the surrounding parts can be effectively prevented. Also, the height of the tiller handle can be selected from two or more possible positions.

Preferably, the front end of the support bracket is provided with a substantially vertical mounting surface on a front side thereof, and the mounting piece being configured to be attached to the mounting surface so that the access required for the adjustment can be gained from the front side for the convenience of the user. In particular, the adjustment piece may be provided with an opening for passing a threaded member therethrough so that the adjustment member can be fixedly secured to the mounting surface by fastening the threaded member. The threaded member may be either a threaded bolt configured to be threaded into a threaded hole formed in the mounting surface or a stud bolt integrally extending from the mounting surface and configured to be fastened by threading a nut engaging the outer surface of the adjustment piece onto the stud bolt.

According to a preferred embodiment, the securing of the adjustment member can be facilitated because the adjustment piece is provided with an overhang that engages at least one side of the front end of the support bracket to prevent rotation of the adjustment piece with respect to the support bracket. Also, the front end of the support bracket may be provided with a stopper portion and a pair of laterally spaced handle support portions extending substantially vertically from either side of the stopper portion, and the first stopper surface may be defined on an upper side of the stopper portion.

For an enhanced stability and durability, the upper and lower surfaces of each spacer portion of the adjustment piece may be angled so as to make a surface contact with the first and second stopper surfaces, respectively.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
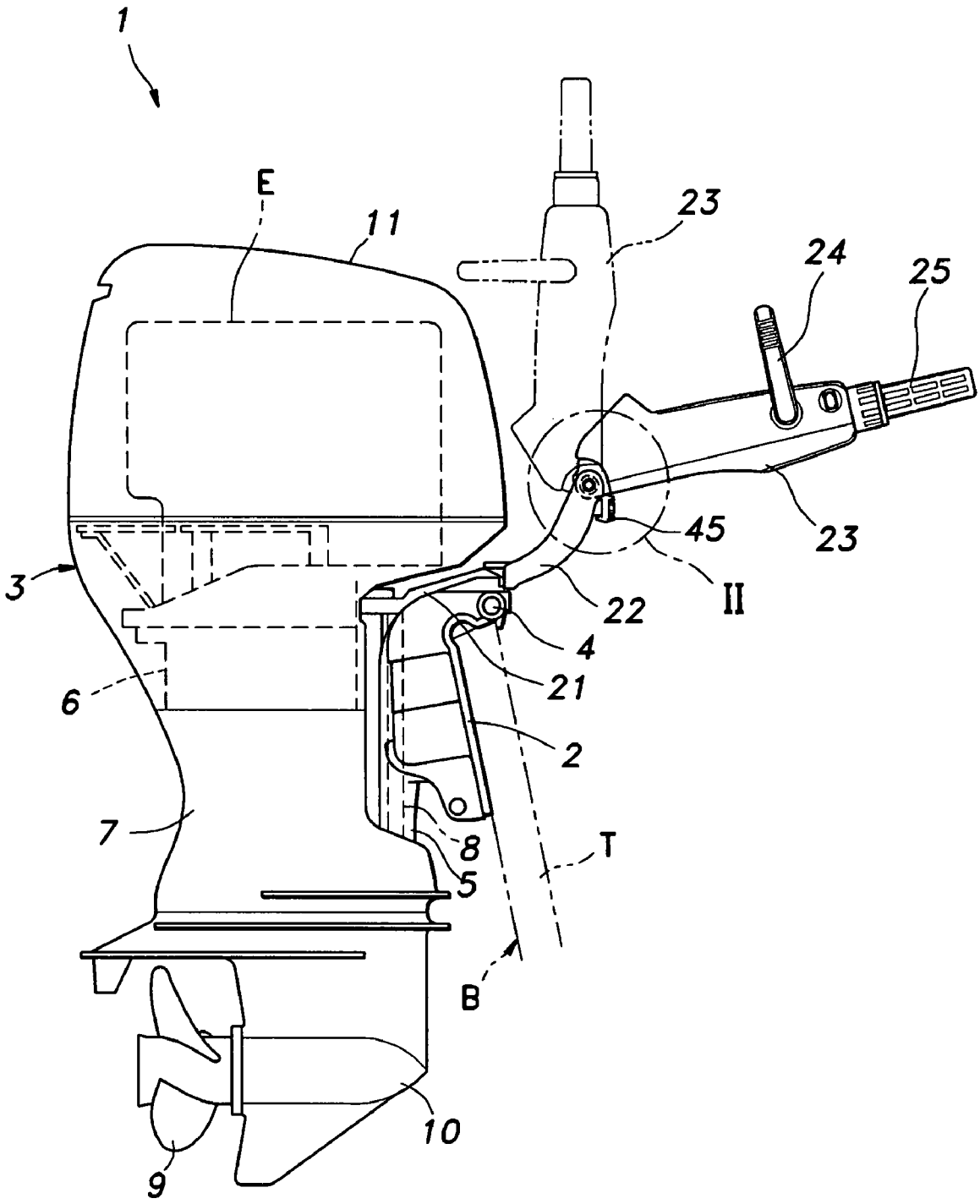
FIG. 1 is a general side view of an outboard motor embodying the present invention.

FIG. 1 shows an outboard motor 1 according to the present invention. A main body 3 of the outboard motor 1 is fixedly secured to a transom board T of a boat B via a stern bracket 2. The stern bracket 2 pivotally supports a swivel case 5 via a laterally extending tilt shaft 4. The swivel case 5 in turn pivotally supports the main body 3 of the outboard motor 1 via a vertically extending swivel shaft 8. An upper part of the swivel shaft 8 supports a front end of an engine mount case 6 which retains an internal combustion engine E, and a lower part of the swivel shaft 8 supports an extension case 7 accommodating a vertical shaft (drive shaft) therein. An upper end of the extension case 7 supports the engine mount case 6 via a rubber mount for vibration isolation (not shown in the drawings), and a lower end of the extension case 7 is connected to a gear case 10 supporting a propeller 9. An upper face of the engine mount case 6 is closed by a detachable engine cover 11 which is shaped as a relatively deep bowl having an open lower end to cover an upper half of the engine E.

A stay 21 extends from a front end of the engine mount case 6, and a handle support bracket 22 is fixedly secured to a front end of the stay 21 by using threaded bolts (not shown in the drawings). A tiller handle 23 is supported by a front end of the handle support bracket 22 via a lateral shaft (hinge bolt 35) so as to be tiltable between a horizontal (forwardly extending) position (indicated by solid lines) suitable for normal operation of the outboard motor and a vertical (upwardly extending) position (indicated by double-dot chain lines) suitable for retracting the tiller handle when the outboard motor 1 is not in use. The tiller handle 23 is fitted with a shift lever 24 for shifting the transmission between forward, neutral and reverse, and a throttle grip 25 for controlling the output of the internal combustion engine E.

Figure 2:
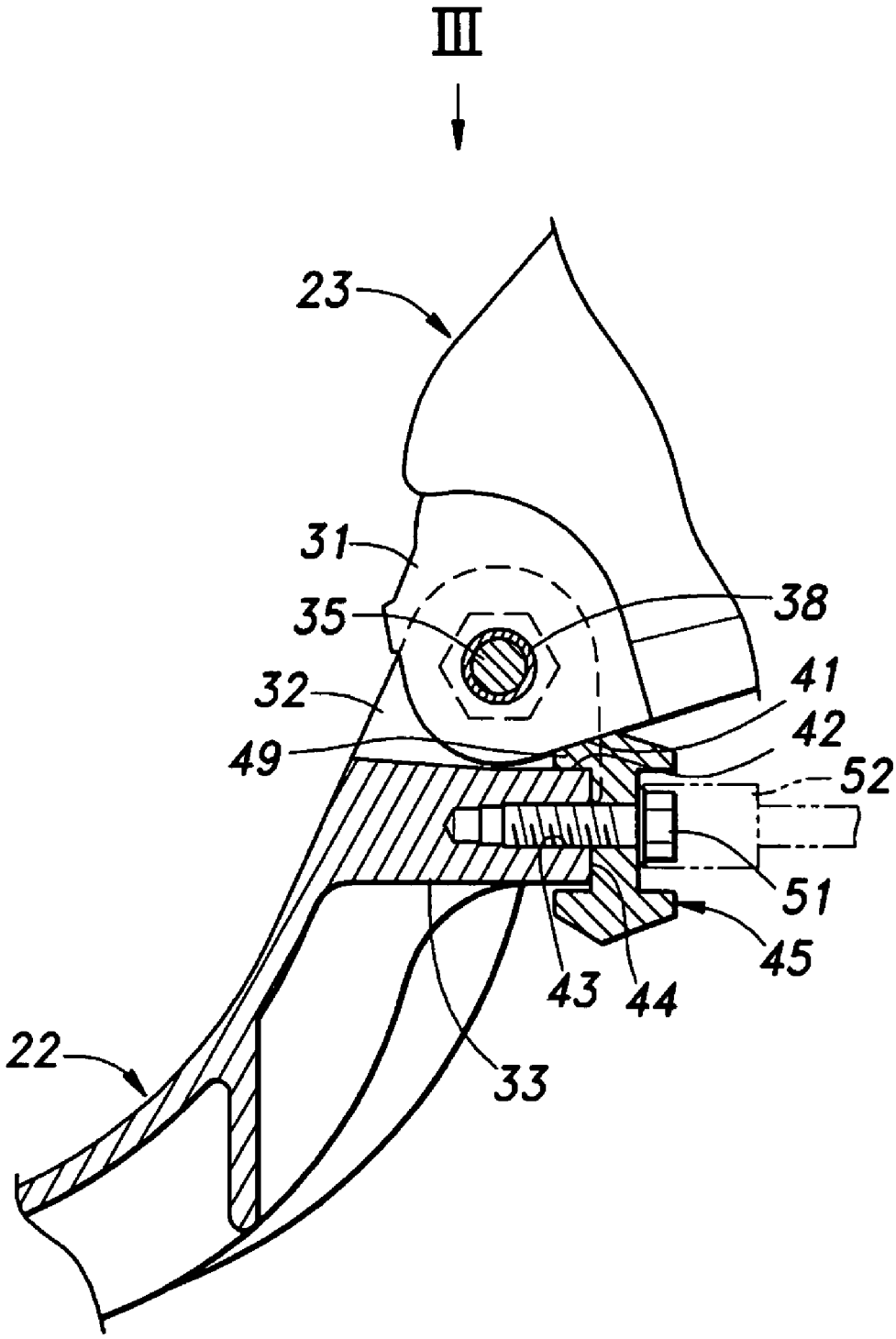
FIG. 2 is an enlarged, partly sectional fragmentary side view of the part indicated by II in FIG. 1.
Figure 3:
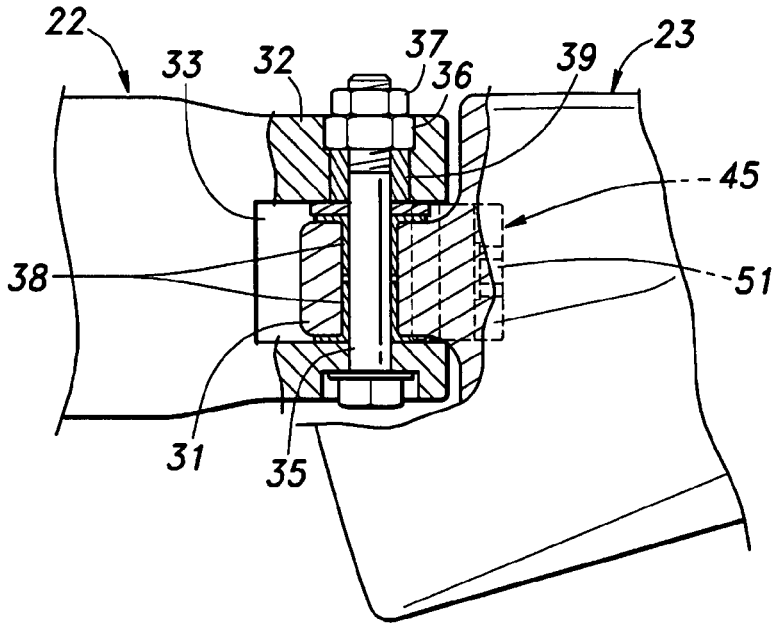
FIG. 3 is an enlarge, partly sectional fragmentary plan view as seen in the direction indicated by III in FIG. 2.

Referring to FIGS. 2 and 3, the front end of the handle support bracket 22 is formed as a bifurcated end that includes a pair of laterally spaced handle support portions 32 interposing a base end 31 of the tiller handle 23 and a stopper portion 33 joining the two handle support portions 32 with each other. The handle support portions 32 extend substantially vertically from the stopper portion 33. The tiller handle 23 is pivotally supported by the hinge bolt 35 passed across the handle support portions 32 and secured thereto by nuts 36 and 37 so that the tiller handle 23 may be pivoted around the hinge bolt 35 or a horizontal axial line with a certain frictional resistance. The bore of the base end of the tiller handle 23 is fitted with a bush 38 that provides a desired frictional property in relation with the outer surface of the hinge bolt 35. The corresponding bore of one of the handle support portions 32 is fitted with a distance collar 39 that provides a controlled frictional force between the handle support bracket 22 and tiller handle 23.

The base end 31 of the tiller handle 23 is provided with a first stopper surface 41 on a lower side thereof, and the stopper portion 33 of the handle support bracket 22 is provided with a corresponding second stopper surface 42 on an upper side thereof. The front side of the stopper portion 33 defines a substantially vertical mounting surface 44 which is centrally provided with a threaded hole 43. An adjustment piece 45 is secured against the mounting surface 44 by a threaded bolt 52 threaded into the threaded hole 43.

Figure 4:
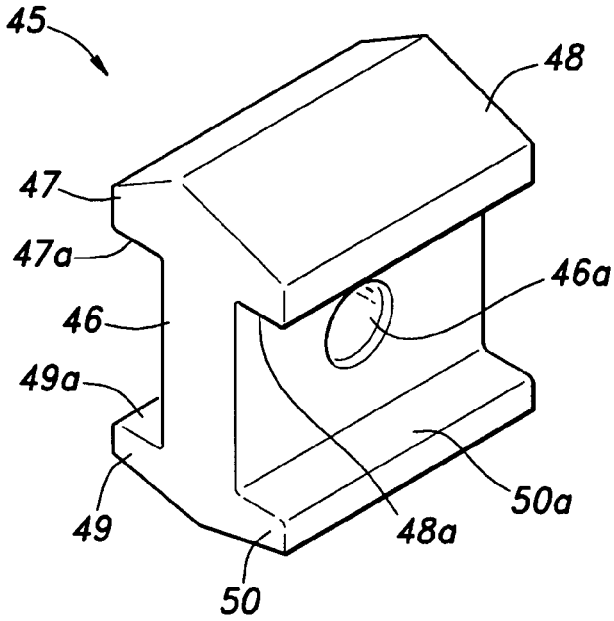
FIG. 4 is a perspective view of the adjustment piece.

As best illustrated in FIG. 4, the adjustment piece 45 comprises a substantially rectangular, planar base portion 46 centrally provided with a mounting hole 46*a* for receiving the threaded bolt 52 therethrough, and four spacer portions 47-50 that extend forward and rearward from upper and lower ends of the base portion 46, respectively. Each spacer portion is provided with a certain thickness and a slanted outer surface. The thicknesses and angles of the outer surfaces of the spacer portions 47-50 progressively increase and decrease, respectively, from one spacer portion to another.

Each spacer portion 47-50 is provided with an overhang portion 47*a*-50*a* that engages an upper surface or lower surface of the stopper portion 33 when the particular overhang portion faces the stopper portion 33. Because each overhang portion engages a planer side (which may be upper or lower sides) of the stopper portion 33 when the adjustment piece 45 is mounted on the mounting surface 44, the adjustment piece 45 is positively prevented from turning when fastening the threaded bolt 35 or during use.

The mode of operation of the illustrated embodiment is described in the following.

It is often desirable to adjust the height of the tiller handle 23 during normal operation of the outboard motor 1 depending on the posture and/or build of the operator. According to the illustrated embodiment, it can be effected by using the adjustment piece 45. As illustrated in FIG. 2, after tilting up the tiller handle 23 into the vertical position as indicated by the imaginary lines in FIG. 1, the operator unfastens the threaded bolt 51 by using a socket wrench 52 as indicated by the imaginary lines in FIG. 2, and removes the adjustment piece 45. If the tiller handle 23 is put back to the operating (horizontal) position as illustrated in FIG. 5*d* under this condition, the tiller handle 23 is at the lowermost position.

Figure 5A:
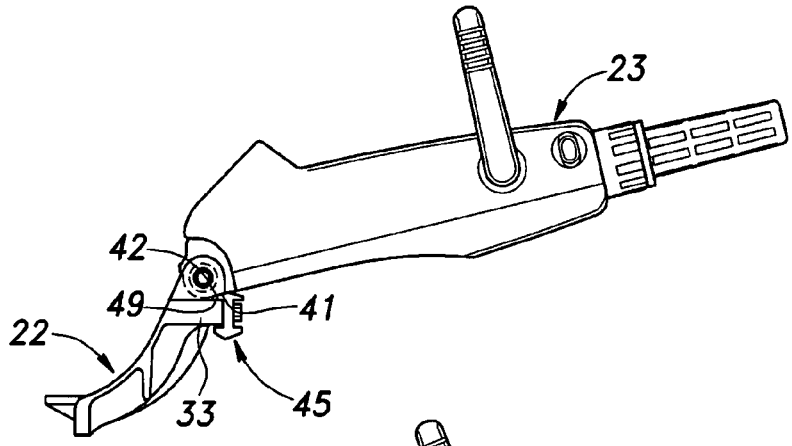
FIGS. 5*a* to 5*d* are side views showing four different adjusted positions of the tiller handle.
Figure 5B:
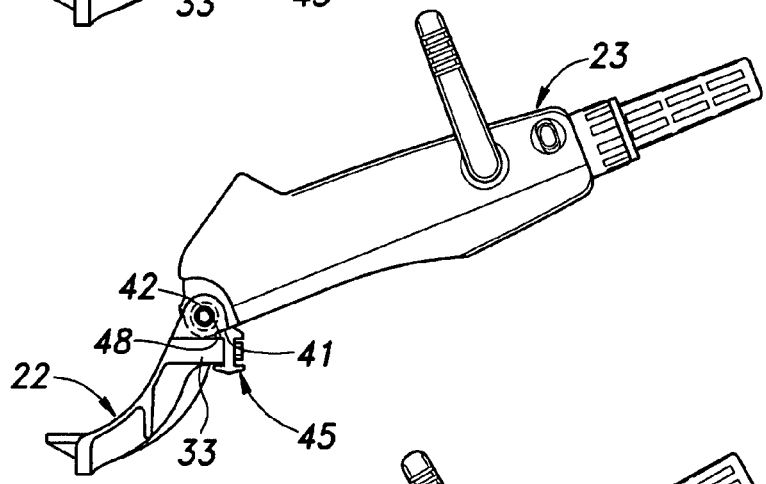
Figure 5C:
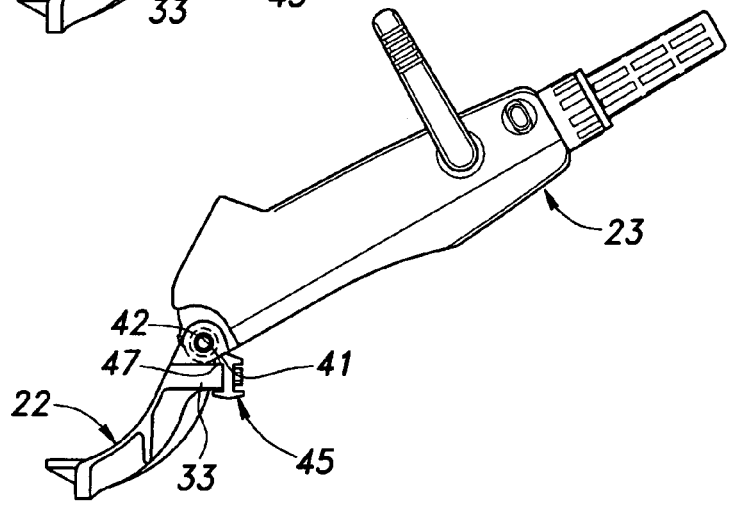
Figure 5D:
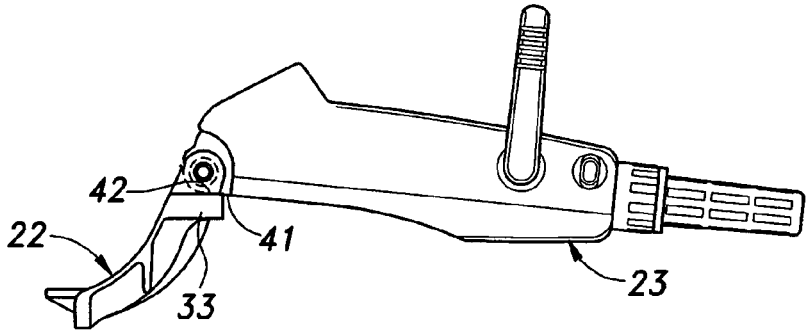

When the adjustment piece 45 is put back in place with the thinnest spacer portion 50 facing upward and rearward as illustrated in FIG. 5*a*, and the tiller handle 23 is put back to the operating (horizontal) position, the tiller handle 23 is then at the second lowest position. By thus choosing any one of the three remaining spacer portions 47 to 49, it is possible to adjust the height of the tiller handle to successively increasing heights as illustrated in FIGS. 5*b* and 5*c*. As there are four spacer portions 47 to 50 having different thicknesses, it is possible to select any one of five different heights for the tiller handle including the choice where the adjustment piece is not used. The tiling angle of the outer surface of each spacer portion is determined in such a manner that the lower surface of the tiller handle 23 makes a surface contact with the corresponding outer surface of the adjustment piece 45. Likewise, the corresponding overhang portion that engages the upper side of the stopper portion 33 may be configured so as to make a surface contact with the corresponding outer surface of the stopper portion 33.

Because the adjustment piece 45 can be attached to and removed from the mounting surface 44 from the front of the support bracket 22, a minimum amount of space is required for the adjustment of the height of the tiller handle 23, and there are substantially no lateral or vertical protrusions owing to the provision of the adjustment piece 45. The adjustment piece 45 consists of a small piece of metallic or plastic material, and is highly inconspicuous without substantially extending from the handle support bracket 22 or tiller handle 23, mostly hidden from view by the tiller handle 23 overlying the adjustment piece 45.

There were four different spacer portions in the foregoing embodiment, but there may be three or less different spacer portions or, by suitably changing the shape of the adjustment piece, five or more different spacer portions.

Although the present invention has been described in terms of preferred embodiments thereof, it is obvious to a person skilled in the art that various alterations and modifications are possible without departing from the scope of the present invention which is set forth in the appended claims.

The contents of the original Japanese patent application on which the Paris Convention priority claim is made for the present application are incorporated in this application by reference.

The invention claimed is:

1. An outboard motor for watercraft, comprising:

a handle support bracket extending forward from a main body of an outboard motor, a front end of the handle support bracket being provided with a first stopper surface on an upper side thereof;

a tiller handle having a base end pivotally supported by the front end of the handle support bracket around a lateral pivot axis between an upwardly tilted retracted position and a forwardly extending operating position, the base end of the tiller handle being provided with a second stopper surface that cooperates with the first stopper surface to determine a height of the tiller handle on a lower side thereof; and an adjustment piece detachably attached to the front end of the handle support bracket;

wherein the adjustment piece is configured to be attached to the front end of the handle support member in two or more different positions and provided with a corresponding number of spacer portions having different thicknesses so as to interpose a selected one of the spacer portions between the first and second stopper surfaces depending on the positions of the adjustment piece.

2. The outboard motor for watercraft according to claim 1, wherein the front end of the support bracket is provided with a substantially vertical mounting surface on a front side thereof, and the mounting piece being configured to be attached to the mounting surface.

3. The outboard motor for watercraft according to claim 2, wherein the adjustment piece is provided with an opening for passing a threaded member therethrough so that the adjustment member can be fixedly secured to the mounting surface by fastening the threaded member.

4. The outboard motor for watercraft according to claim 3, wherein the adjustment piece is provided with an overhang that engages at least one side of the front end of the support bracket to prevent rotation of the adjustment piece with respect to the support bracket.

5. The outboard motor for watercraft according to claim 1, wherein the front end of the support bracket is provided with a stopper portion and a pair of laterally spaced handle support portions extending substantially vertically from either side of the stopper portion, and the first stopper surface is defined on an upper side of the stopper portion.

6. The outboard motor for watercraft according to claim 1, wherein the upper and lower surfaces of each spacer portion of the adjustment piece are angled so as to make a surface contact with the first and second stopper surfaces, respectively.

* * * * *